US008228270B2

(12) United States Patent
Park et al.

(10) Patent No.: US 8,228,270 B2
(45) Date of Patent: Jul. 24, 2012

(54) DISPLAY DEVICE AND DRIVING METHOD THEREOF

(75) Inventors: Kyong-Tae Park, Suwon-si (KR); Baek-Woon Lee, Yongin-si (KR); Alexander Arkhipov, Suwon-si (KR)

(73) Assignee: Samsung Electronics Co. Ltd., Suwon-si (KR)

( * ) Notice: Subject to any disclaimer, the term of this patent is extended or adjusted under 35 U.S.C. 154(b) by 850 days.

(21) Appl. No.: 12/360,526

(22) Filed: Jan. 27, 2009

(65) Prior Publication Data

US 2010/0053137 A1 Mar. 4, 2010

(30) Foreign Application Priority Data

Sep. 3, 2008 (KR) ..... 10-2008-0086895

(51) Int. Cl.
*G09G 3/32* (2006.01)

(52) U.S. Cl. ..... 345/82; 345/55; 345/83

(58) Field of Classification Search ..... 345/55, 345/76, 77, 82, 83, 84, 87
See application file for complete search history.

(56) References Cited

U.S. PATENT DOCUMENTS 7,447,379 B2 * 11/2008 Choe et al. ..... 382/274
7,742,019 B2 * 6/2010 Takahara ..... 345/76
2007/0080905 A1 * 4/2007 Takahara ..... 345/76
2009/0184984 A1 * 7/2009 Takahara ..... 345/690
2009/0213048 A1 * 8/2009 Park et al. ..... 345/77

FOREIGN PATENT DOCUMENTS

| | | |
|---|---|---|
| JP | 05300453 | 11/1993 |
| JP | 09212129 | 8/1997 |
| JP | 10031449 | 2/1998 |
| JP | 2004117690 | 4/2004 |
| JP | 2006349966 | 12/2006 |
| KR | 1020060046784 | 5/2006 |
| KR | 1020060067503 | 6/2006 |
| KR | 100600314 | 7/2006 |
| KR | 100600332 | 7/2006 |
| KR | 100636506 | 10/2006 |
| KR | 100696280 | 3/2007 |

* cited by examiner

*Primary Examiner* — My-Chau T Tran
(74) *Attorney, Agent, or Firm* — H.C. Park & Associates, PLC

(57) ABSTRACT

In a display device, a signal controller compensates for luminance of an input image signal that corresponds to each of a plurality of pixels in accordance with a luminance compensation coefficient depending on a position of each pixel, and generates a compensation image signal. A data driver generates data signals that correspond to the plurality of pixels in accordance with the compensation image signal, and supplies the data signals to the corresponding pixels, respectively. The luminance compensation coefficient may depend on a magnitude of the input image signal.

20 Claims, 12 Drawing Sheets

DISPLAY DEVICE AND DRIVING METHOD THEREOF

CROSS REFERENCE TO RELATED APPLICATION

This application claims priority from and the benefit of Korean Patent Application No. 10-2008-0086895, filed on Sep. 3, 2008, which is hereby incorporated by reference for all purposes as if fully set forth herein.

BACKGROUND OF THE INVENTION

1. Field of the Invention

The present invention relates to a display device and a driving method thereof.

2. Discussion of the Background

In general, a plurality of pixels are arranged in a matrix form in display devices, and images are displayed by controlling light intensity of each pixel according to given luminance information. Among display devices, an organic light emitting display is a display device that electrically excites a fluorescent organic material to emit light so as to display images. Since the organic light emitting display is a self-emission type, has low power consumption, a wide viewing angle, and a fast pixel response speed, it may be easy to display high-quality moving pictures. An organic light emitting display pixel includes at least one subpixel to display a desired color.

One subpixel of the organic light emitting display includes an organic light emitting element, which is typically an organic light emitting diode (OLED), and a driving transistor that drives the OLED. The driving transistor is supplied with a driving voltage from a driving voltage line to drive the OLED. In general, since driving transistors of a plurality of subpixels are commonly connected to one driving voltage line, a voltage drop may be generated due to a parasitic component existing on the driving voltage line. As a result, a driving voltage supplied to each subpixel may be different according to a position of the subpixel along the driving voltage line. When a subpixel is distant from a pad where a driving voltage line is connected to an external power supply, a driving voltage thereof may be low.

As a result, since a driving voltage of a thin film transistor may be different for each subpixel, luminance may be different with respect to the same gray. Accordingly, brightness uniformity of a screen may be deteriorated. Particularly, when high gray display is performed, a current that flows through a driving voltage line increases, which may result in increasing a voltage drop. Accordingly, a deviation of a driving voltage may increase. That is, brightness uniformity of a screen in a high gray may be further deteriorated.

SUMMARY OF THE INVENTION

The present invention provides a display device and a driving method thereof.

Additional features of the invention will be set forth in the description which follows, and in part will be apparent from the description, or may be learned by practice of the invention.

The present invention discloses a display device that includes a plurality of pixels, a signal controller, and a data driver. The signal controller compensates luminance of an input image signal that corresponds to each pixel according to a luminance compensation coefficient that depends on a position of each pixel and magnitude of the input image signal that corresponds to each pixel, and generates a compensation image signal. The data driver generates data signals that correspond to the plurality of pixels according to the compensation image signal and respectively supplies the data signals to the corresponding pixels.

The present invention also discloses a method of driving a display device that includes a plurality of pixels. The method includes determining positions of the plurality of pixels; calculating a magnitude of an input image signal that corresponds to each pixel; generating a luminance compensation coefficient that depends on the position of each pixel and the magnitude of the input image signal; compensating for luminance of the input image signal that corresponds to each pixel in accordance with the luminance compensation coefficient to generate a compensation image signal; and allowing each pixel to emit light in accordance with the compensation image signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
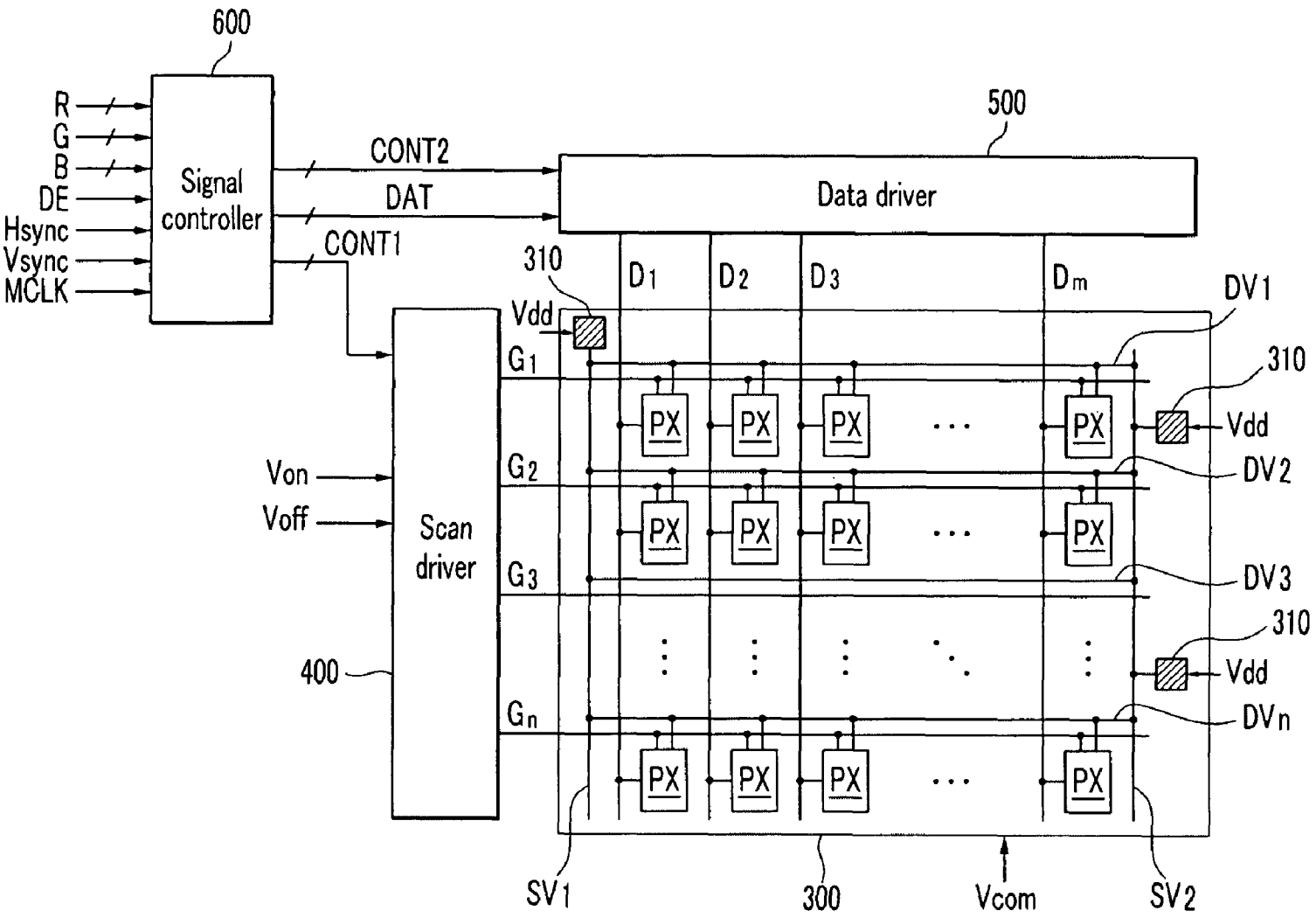
FIG. 1 is a block diagram showing an organic light emitting display according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

A display device and a driving method thereof according to an exemplary embodiment of the present invention will now be described in detail with reference to the accompanying drawings.

An organic light emitting display according to an exemplary embodiment of the present invention will be described in detail with reference to FIG. 1 and FIG. 2.

Figure 2:
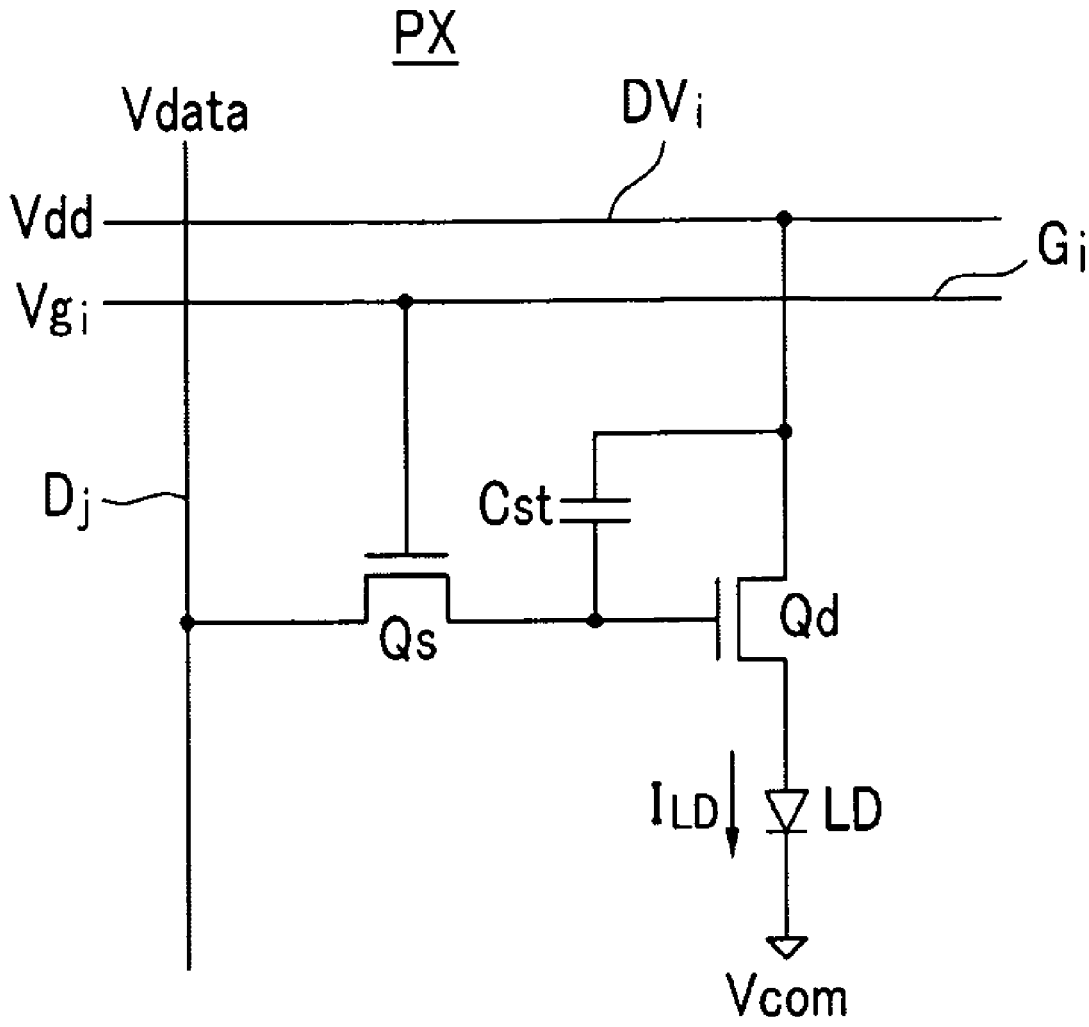
FIG. 2 is an equivalent circuit diagram of one subpixel in an organic light emitting display according to an exemplary embodiment of the present invention.

FIG. 1 is a block diagram showing an organic light emitting display according to an exemplary embodiment of the present invention, and FIG. 2 is an equivalent circuit diagram of one subpixel in an organic light emitting display according to an exemplary embodiment of the present invention.

Referring to FIG. 1, an organic light emitting display according to an exemplary embodiment of the present invention includes a display panel 300, a scan driver 400, a data driver 500, and a signal controller 600.

Referring to FIG. 1, the display panel 300 includes a plurality of signal lines $G_1$ to $G_n$ and $D_1$ to $D_m$, a plurality of subpixels PX that are connected to the plurality of signal lines $G_1$ to $G_n$ and $D_1$ to $D_m$ and arranged in a matrix form, a plurality of driving voltage lines $DV_1$ to $DV_n$, voltage supply lines $SV_1$ and $SV_2$ that are connected to the plurality of driving voltage lines $DV_1$ to $DV_n$, and at least one voltage supply pad 310.

The signal lines $G_1$ to $G_n$ and $D_1$ to $D_m$ include a plurality of scan lines $G_1$ to $G_n$ that transmit scan signals and a plurality of data lines $D_1$ to $D_m$ that transmit data signals according to input image signals. The data signal may be a data voltage or a data current according to a type of subpixel PX. The scan lines $G_1$ to $G_n$ extend in a row direction and are disposed substantially parallel to each other, and the data lines $D_1$ to $D_m$ extend in a column direction and are disposed substantially parallel to each other. The plurality of subpixels PX are formed in regions that are defined by the scan lines $G_1$ to $G_n$ and the data lines $D_1$ to $D_m$, respectively.

The driving voltage lines $DV_1$ to $DV_n$ extend in a row direction and are disposed substantially parallel to each other, and are connected to each row of subpixels (hereinafter, referred to as "subpixel row"). Alternatively, one of the driving voltage lines $DV_1$ to $DV_n$ may be commonly connected to a plurality of subpixel rows. The voltage supply lines $SV_1$ and $SV_2$ extend in a column direction, are connected to both ends of the driving voltage lines $DV_1$ to $DV_n$, and transmit the driving voltage to the driving voltage lines $DV_1$ to $DV_n$. Alternatively, one voltage supply line may be connected to only one end of the driving voltage lines $DV_1$ to $DV_n$. At least one voltage supply pad 310 is connected to the voltage supply lines $SV_1$ and $SV_2$ at predetermined positions, and transmits a driving voltage Vdd supplied by an external power supply (not shown) to the voltage supply lines $SV_1$ and $SV_2$.

Alternatively, the driving voltage lines may extend in a column direction. In this case, each of the driving voltage lines may be connected to subpixels of at least one column.

Referring to FIG. 2, each of the subpixels PX, for example a subpixel PX that is connected to an i-th (i=1, 2, . . . , and n) scan line $G_i$ and a j-th (j=1, 2, . . . , and m) data line $D_j$, includes an organic light emitting element LD, a driving transistor Qd, a storage capacitor Cst, and a switching transistor Qs. The subpixel PX shown in FIG. 2 is an example of a subpixel PX using a data voltage.

The switching transistor Qs has a control terminal, an input terminal, and an output terminal. The control terminal is connected to the scan line $G_i$, the input terminal is connected to the data line $D_j$, and the output terminal is connected to the driving transistor Qd. The switching transistor Qs transmits a data voltage Vdata applied to the data line $D_j$ in response to the scan signal applied to the scan line $G_i$.

The driving transistor Qd also has a control terminal, an input terminal, and an output terminal. The control terminal is connected to the output terminal of the switching transistor Qs, the input terminal is connected to a driving voltage line $DV_i$ that transmits the driving voltage Vdd, and the output terminal is connected to an organic light emitting element LD. The driving transistor Qd flows an output current $I_{LD}$ whose magnitude changes depending on a voltage between the control terminal and the output terminal of the driving transistor Qd.

The storage capacitor Cst is connected between the control terminal and the input terminal of the driving transistor Qd. The storage capacitor Cst charges the data voltage Vdata that is applied to the control terminal of the driving transistor Qd, and maintains the data voltage Vdata even after the switching transistor Qs is turned off.

The organic light emitting element LD may be an organic light emitting diode (OLED), and it has an anode that is connected to the output terminal of the driving transistor Qd and a cathode that is connected to a terminal of a common voltage Vcom. The organic light emitting element LD emits light with intensity that changes depending on the output current $I_{LD}$ of the driving transistor Qd, thereby displaying an image.

The organic light emitting element LD can emit light that has one of three primary colors red, green, and blue. The organic light emitting element LD displays a desired color by a spatial sum or temporal sum of the three primary colors. In this case, some organic light emitting element LDs can emit white light. As a result, luminance may be increased. Alternatively, organic light emitting elements LD of all the subpixels PX may emit white light, and some subpixels PX may further include a color filter (not shown) that changes white light emitted from the organic light emitting elements LD into light of one primary color.

A pixel that displays a desired color may include three subpixels PX (hereinafter referred to as a "red subpixel", a "green subpixel", and a "blue subpixel") that display red, green, and blue, respectively, and may further include a subpixel (hereinafter referred to as a "white subpixel") that displays white. Each subpixel can display a corresponding color through light emitted from the organic light emitting element LD or the color filter.

Each switching transistor Qs and driving transistor Qd may be an n-channel field effect transistor (FET) that is made of amorphous silicon or polysilicon. However, at least one of the switching transistor Qs and the driving transistor Qd may be a p-channel field effect transistor. In this case, a connection relationship between the transistors Qs and Qd, the capacitor Cst, and the organic light emitting element LD may be changed.

Referring back to FIG. 1, the scan driver 400 is connected to the scan lines $G_1$ to $G_n$ of the display panel 300, and applies a scan signal, which is composed of a high voltage Von that is capable of turning on the switching transistor Qs, and a low voltage Voff, which is capable of turning off the switching transistor Qs, to the scan lines $G_1$ to $G_n$.

The data driver 500 is connected to the data lines $D_1$ to $D_m$ of the display panel 300 and applies a data voltage to the data lines $D_1$ to $D_m$. The data driver 500 may select a data voltage from entire gray voltages that are related to luminance of the subpixels PX, or may divide a limited number of reference gray voltages to generate a desired data voltage.

The signal controller 600 controls the scan driver 400 and the data driver 500.

Each driving device 400, 500, and 600 may be directly mounted on the display panel 300 in a form of at least one integrated circuit (IC) chip, mounted on a flexible printed circuit film (not shown) to be attached to the display panel 300 in a form of a tape carrier package (TCP), or mounted on a separate printed circuit board (PCB) (not shown). Alternatively, the driving devices 400, 500, and 600 may be integrated in the display panel 300 together with the signal lines $G_1$ to $G_n$ and $D_1$ to $D_m$ and the switching transistors Qs. Further, the driving devices 400, 500, and 600 may be integrated with a single chip. In this case, at least one of the driving devices 400, 500, and 600 or at least one circuit element that constitutes the driving devices 400, 500, and 600 may be disposed outside the single chip.

Next, an operation of the organic light emitting display will be described in detail.

The signal controller 600 receives input image signals R, G, and B and input control signals for controlling the display thereof from an external graphics controller (not shown). The input image signals R, G, and B include luminance information of each subpixel PX, and luminance has a predetermined number of gray levels, for example, 1024 ($=2^{10}$), 256 ($=2^8$), or 64 ($=2^6$). Examples of the input control signals include a vertical synchronization signal Vsync, a horizontal synchronization signal Hsync, a main clock signal MCLK, and a data enable signal DE.

The signal controller 600 appropriately processes the input image signals R, G, and B according to the operation conditions of the display panel 300 on the basis of the input control signals. The signal controller 600 generates a scan control signal CONT1 and a data control signal CONT2 and outputs the scan control signal CONT1 to the scan driver 400 and the data control signal CONT2 and a processed image signal DAT to the data driver 500.

The scan control signal CONT1 includes a scanning start signal STV (not shown) indicating the start of scanning and at least one clock signal (not shown) for controlling the output cycle of the high voltage Von. The scan control signal CONT1 may further include an output enable signal OE (not shown) that defines the duration of the high voltage Von.

The data control signal CONT2 includes a horizontal synchronization start signal STH (not shown) indicating that the transmission of a digital image signal DAT to a row of subpixels PX starts, a load signal LOAD (not shown) that allows an analog data voltage to be applied to the data lines $D_1$ to $D_m$, and a data clock signal HCLK (not shown).

The data driver 500 receives the digital image signal DAT for a row of subpixels PX according to the data control signal CONT2 transmitted from the signal controller 600, selects a gray voltage corresponding to each digital image signal DAT, converts the digital image signal DAT into an analog data voltage, and applies the analog data voltage to the data lines $D_1$ to $D_m$.

The scan driver 400 applies the high voltage Von to the scan lines $G_1$ to $G_n$ in accordance with the scan control signal CONT1 from the signal controller 600 and turns on the switching transistors Qs connected to the scan lines $G_1$ to $G_n$. Then, the data voltages applied to the data lines $D_1$ to $D_m$ are transmitted to the corresponding subpixels PX through the switching transistors Qs that are turned on.

The driving transistor Qd is supplied with a data voltage through the turned-on switching transistor Qs and generates a corresponding output current $I_{LD}$. The organic light emitting element LD emits light having intensity that corresponds to the output current $I_{LD}$ of the driving transistor Qd.

These processes are repeatedly performed for every one horizontal period (which is referred to as "1H" and is equal to one period of the horizontal synchronization signal Hsync and the data enable signal DE]. In this way, the high voltage Von is sequentially applied to all the scan lines $G_1$ to $G_n$, and the data voltages are supplied to all the subpixels PX, thereby displaying one frame of images.

Next, a method in which the signal controller 600 processes the input image signals R, G, and B will be described in detail with reference to FIG. 3, FIG. 4, FIG. 5, FIG. 6, and FIG. 7.

Figure 3:
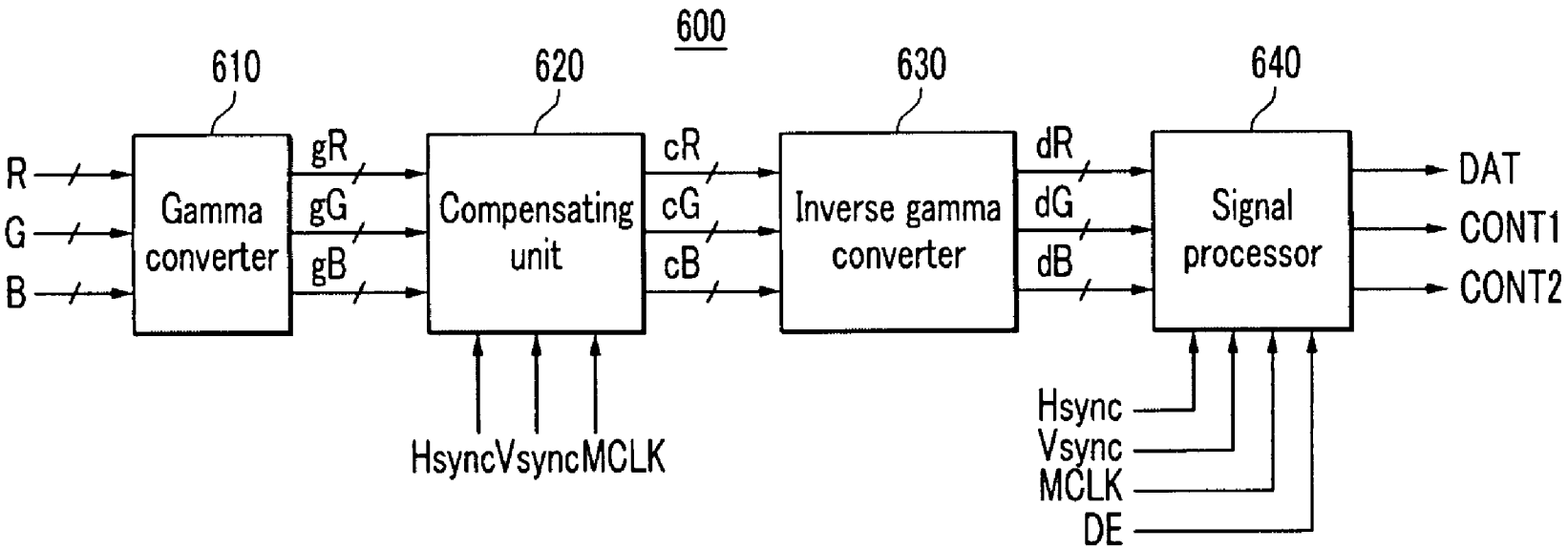
FIG. 3 is a block diagram showing a signal controller of an organic light emitting display according to an exemplary embodiment of the present invention.
Figure 4:
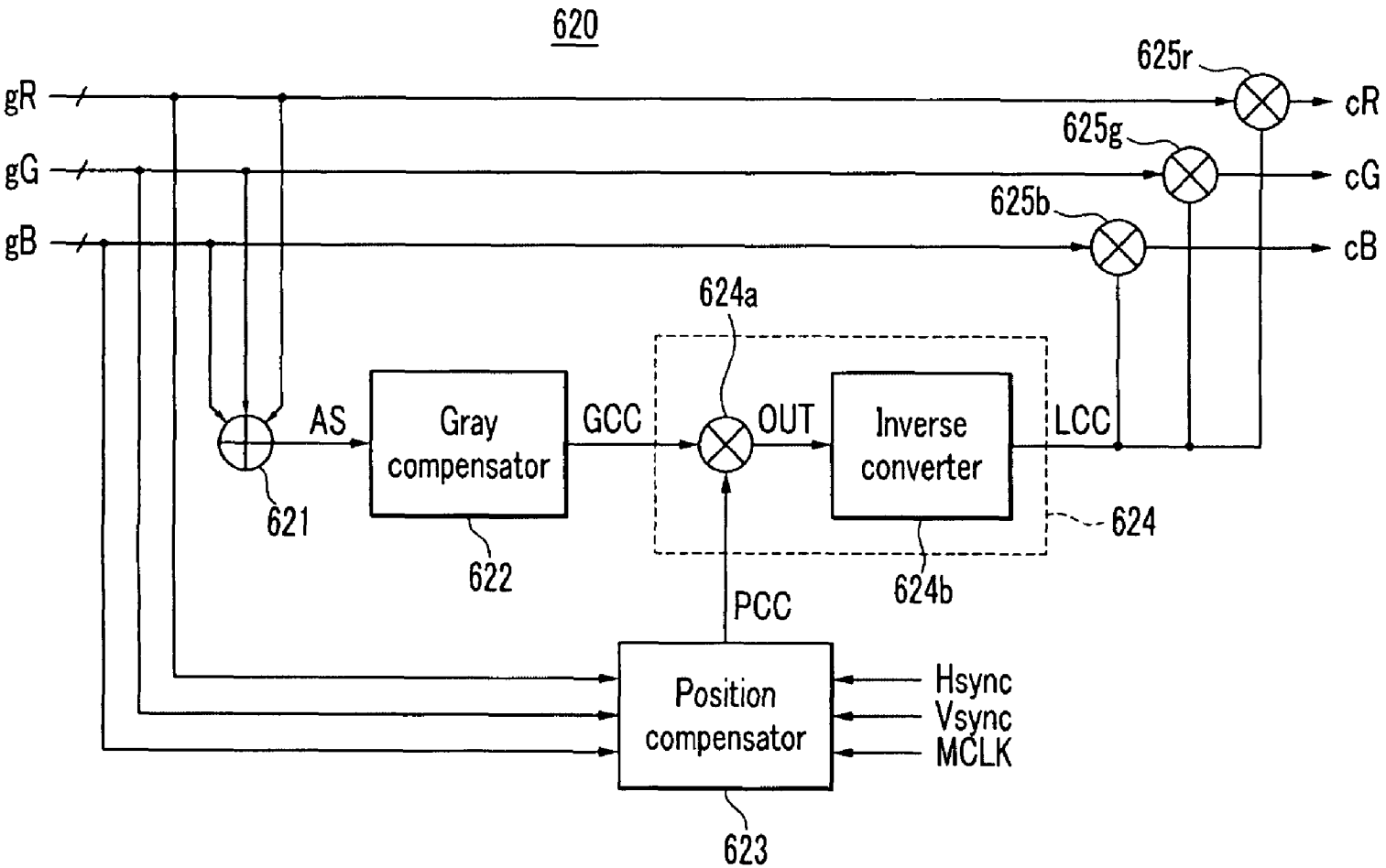
FIG. 4 is a block diagram showing an example of a compensating unit shown in FIG. 3.
Figure 5:
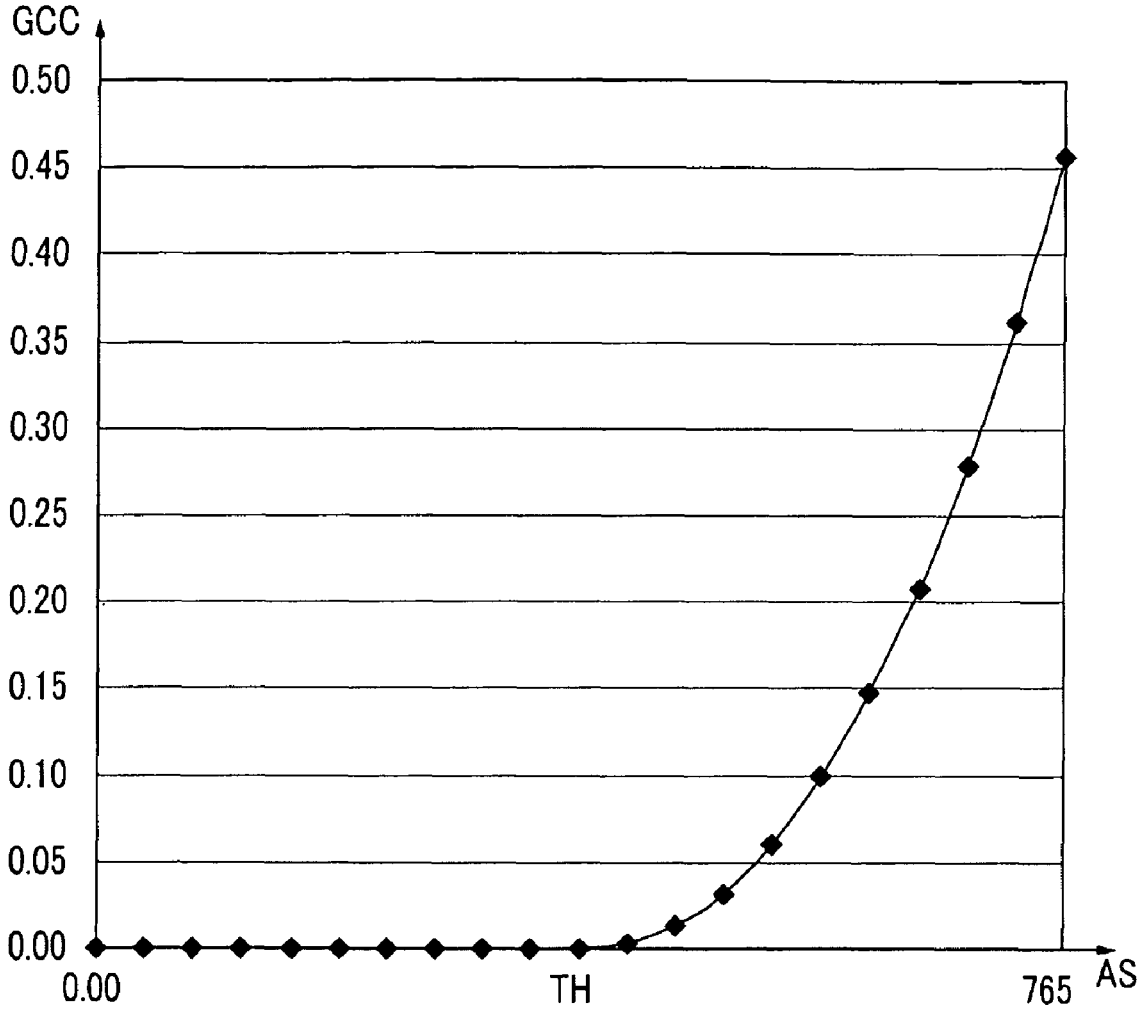
FIG. 5 is a diagram showing a gray compensation coefficient according to an addition signal of input image signals.
Figure 6:
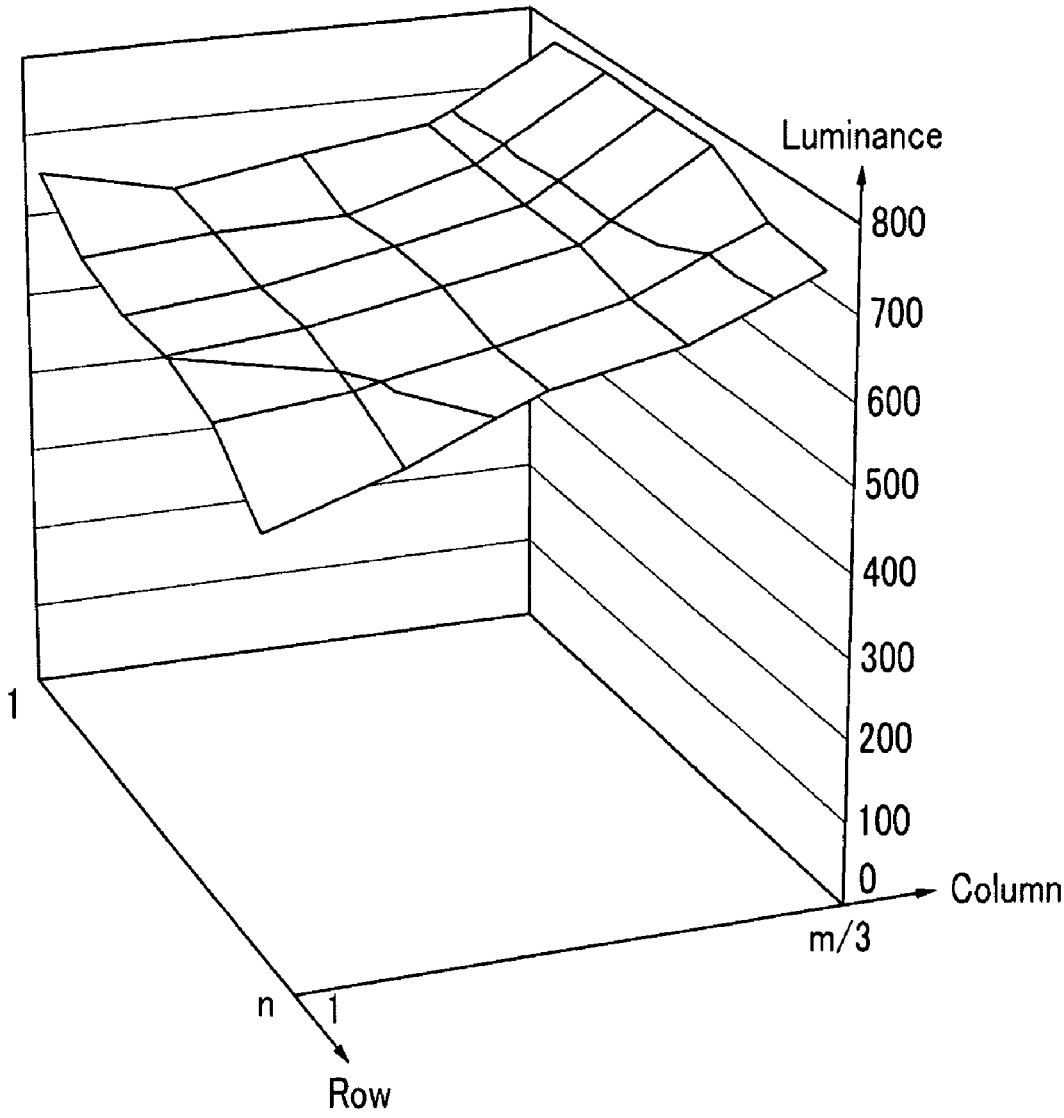
FIG. 6 is a diagram showing luminance according to a position of a pixel in a display panel.
Figure 7:
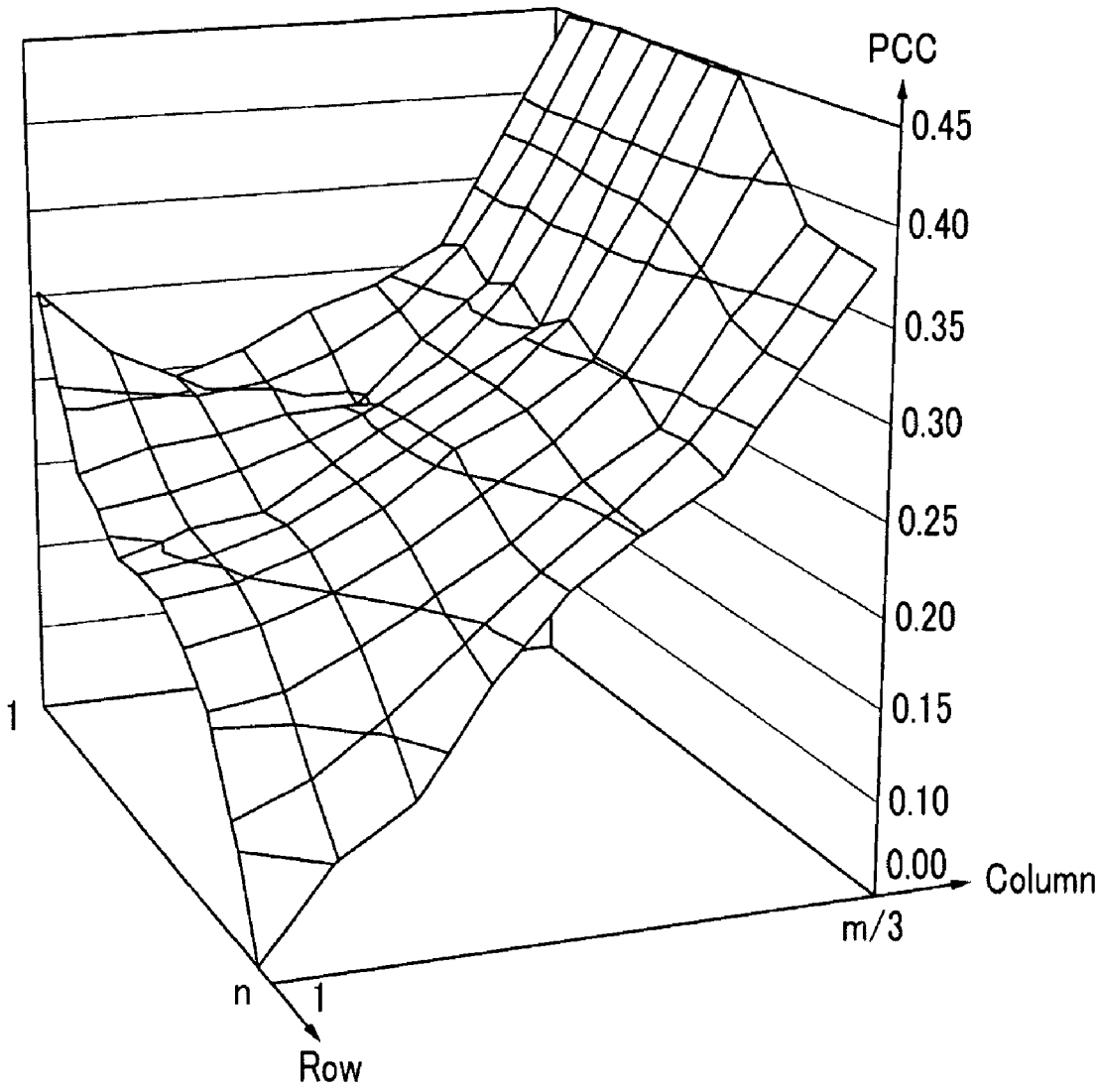
FIG. 7 is a diagram showing a position compensation coefficient according to a position of a pixel in a display panel.

FIG. 3 is a block diagram showing a signal controller of an organic light emitting display according to an exemplary embodiment of the present invention, and FIG. 4 is a block diagram showing an example of a compensating unit shown in FIG. 3. FIG. 5 is a diagram showing a gray compensation coefficient according to an addition signal of input image signals, FIG. 6 is a diagram showing luminance according to a position of a pixel in a display panel, and FIG. 7 is a diagram showing a position compensation coefficient according to a position of a pixel in a display panel.

Referring to FIG. 3, the signal controller 600 includes a gamma converter 610, a compensating unit 620, an inverse gamma converter 630, and a signal processor 640.

The gamma converter 610 performs a gamma conversion on the input image signals R, G, and B and outputs the gamma converted image signals gR, gG, and gB. The compensating unit 620 determines the positions of subpixels that correspond to gamma-converted image signals gR, gG, and gB on the basis of the input control signals, for example the horizontal synchronization signal Hsync, the vertical synchronization signal Vsync, and the main clock signal MCLK, and compensates for the image signals gR, gG, and gB according to the positions of the subpixels and the gray levels thereof and outputs the compensated image signals cR, cG, and cB. For example, when a red subpixel, a green subpixel, and a blue subpixel that are sequentially arranged in a row direction form one pixel, m/3 pixels may be arranged in a row direction and n pixels may be arranged in a column direction in the display panel.

The inverse gamma converter 630 performs an inverse gamma conversion on the image signals cR, cG, and cB that are compensated by the compensating unit 620. The signal processor 640 processes the input control signals, for example the horizontal synchronization signal Hsync, the vertical synchronization signal Vsync, the main clock signal MCLK, and the data enable signal DE, and the inverse-gamma-converted image signals dR, dG, and dB, and generates the digital image signal DAT, the scan control signal CONT1, and the data control signal CONT2.

Referring to FIG. 4, the compensating unit 620 includes an adder 621, a gray compensator 622, a position compensator 623, a compensation coefficient generator 624, and a plurality of multipliers 625*r*, 625*g*, and 625*b*.

When the pixel displays a desired color by a spatial sum or a temporal sum of red, green, and blue, the adder 621 adds the red, green, and blue image signals gR, gG, and gB and outputs an addition signal AS. The magnitude of the addition signal AS indicates luminance of the pixel.

The gray compensator 622 generates a gray compensation coefficient GCC on the basis of the addition signal AS. When the luminance of the pixel is high, a current that flows through the driving voltage lines increases, which results in increasing a voltage drop. Thus, when the value of the addition signal AS of the pixel increases, the gray compensator 622 can set the gray compensation coefficient GCC to have a large value. The gray compensator 622 can set the gray compensation coefficient GCC as a value between 0 and 1. For example, as shown in FIG. 5, when the value of the addition signal AS is not more than a threshold value TH, the gray compensator 622 may set the gray compensation coefficient GCC as 0, and when the value thereof is larger than the threshold value (TH), the gray compensator 622 may set the gray compensation coefficient GCC to have a large value, when the value of the addition signal AS increases. The threshold value TH is determined according to a characteristic of the display panel 300 and may become a magnitude of the addition signal AS when the voltage drop generated along the driving voltage lines begins to affect luminance.

The gray compensator 622 may store the gray compensation coefficient GCC according to the magnitude of the addition signal AS in the form of a look-up table.

The position compensator 623 determines the positions of the pixels that correspond to the image signals gR, gG, and gB on the basis of the input control signals, for example the vertical synchronization signal Vsync, the horizontal synchronization signal Hsync, and the main clock signal MCLK, and outputs the position compensation coefficients PCC corresponding to the positions. As the distance between pixels and the voltage supply pad 310 increases, the amount of the voltage drop that is generated along the driving voltage lines increases. Thus, when the position of the pixel becomes close to the position of the voltage supply pad 310 along the driving voltage lines $DV_1$ to $DV_n$ and the voltage supply lines $SV_1$ and $SV_2$, the position compensator 623 may set the position compensation coefficient PCC to have a large value. At this time, the position compensator 623 may set the position compensation coefficient PCC as a value between 0 and 1. For example, when luminance of the pixels on the display panel 300 with respect to the same gray level is distributed as shown in FIG. 6, the position compensator 623 may set the position compensation coefficient PCC as shown in FIG. 7. That is, the position compensation coefficient PCC may have a large value when luminance is high and may be zero when the luminance is low.

The position compensator 623 may store the position compensation coefficient PCC according to the position of the pixel in the form of a lookup table. In this case, the position compensator 623 can store the position compensation coefficients PCC with respect to all of the positions of the pixels. Alternatively, the position compensator 623 may store positions of some of the pixels (hereinafter referred to as "representative pixels"), and interpolate the position compensation coefficients PCC of the representative pixels with respect to the other pixels to generate the position compensation coefficients PCC of the corresponding pixels.

The compensation coefficient generator 624 generates the luminance compensation coefficient LCC from the gray compensation coefficient GCC and the position compensation coefficient PCC. For example, the compensation coefficient generator 624 includes a multiplier 624*a* and an inverse converter 624*b*. The multiplier 624*a* multiplies the gray compensation coefficient GCC of the gray compensator 622 and the position compensation coefficient PCC of the position compensator 623, and outputs the result. The inverse converter 624*b* outputs a difference (1−OUT) between 1 and a value OUT output from the multiplier 624*a* as the luminance compensation coefficient LCC. For example, the gray compensation coefficient GCC and the position compensation coefficient PCC have a binary digital value, and the inverse converter 624*b* may perform an inverse bit conversion on an output of the multiplier 624*a* and output the position compensation coefficient PCC.

The multipliers 625*r*, 625*g*, and 625*b* are formed to correspond to red, green, and blue image signals gR, gG, and gB, and multiply the red, green, and blue image signals gR, gG, and gB by the luminance compensation coefficients LCC to output the compensation image signals cR, cG, and cB.

When the value of the luminance of the pixel is smaller than a threshold value TH, the gray compensation coefficient GCC is 0, and the luminance compensation coefficient LCC always has a value of 1 regardless of the position compensation coefficient (PCC). Accordingly, the compensation image signals cR, cG, and cB have the same values as the image signals gR, gG, and gB. In contrast, when the value of the luminance of the pixel is larger than the threshold value TH, the gray compensation coefficient GCC has a value larger than 0, and the luminance compensation coefficient LCC has a value smaller than 1. Accordingly, the compensation image signals cR, cG, and cB have values smaller than those of the image signals gR, gG, and gB. That is, when luminance of the pixel increases, the gray compensation coefficient GCC increases, which results in decreasing the luminance compensation coefficient LCC. Thus, the compensation image signals cR, cG, and cB have values smaller than those of the image signals gR, gG, and gB. Accordingly, when the luminance of the pixel is high, the voltage drop that is generated in the driving voltage lines may be reduced by decreasing the luminance of the pixel. Accordingly, it may be possible to improve brightness uniformity of the screen.

When the position of the pixel becomes close to the position of the voltage supply pad 310, the position compensation coefficient PCC increases. Accordingly, the luminance compensation coefficient LCC decreases. As a result, the compensation image signals cR, cG, and cB of the pixels that are supplied with the high driving voltage along the driving voltage lines have values smaller than the values of the image signals gR, gG, and gB by the luminance compensation coefficient LCC. That is, since the luminance that is increased by the high driving voltage can be reduced by the luminance compensation coefficient LCC, it may be possible to prevent deterioration of screen brightness uniformity.

Meanwhile, in an exemplary embodiment of the present invention, the image signals that have been gamma-converted are inverse-gamma-converted by the compensating unit 620. Alternatively, the compensating unit 620 can compensate for the input image signals that are not gamma-converted. In this alternative embodiment, the gamma converter 610 and the inverse gamma converter 630 can be omitted.

Next, an organic light emitting display according to another exemplary embodiment of the present invention will be described in detail with reference to FIG. 8.

Figure 8:
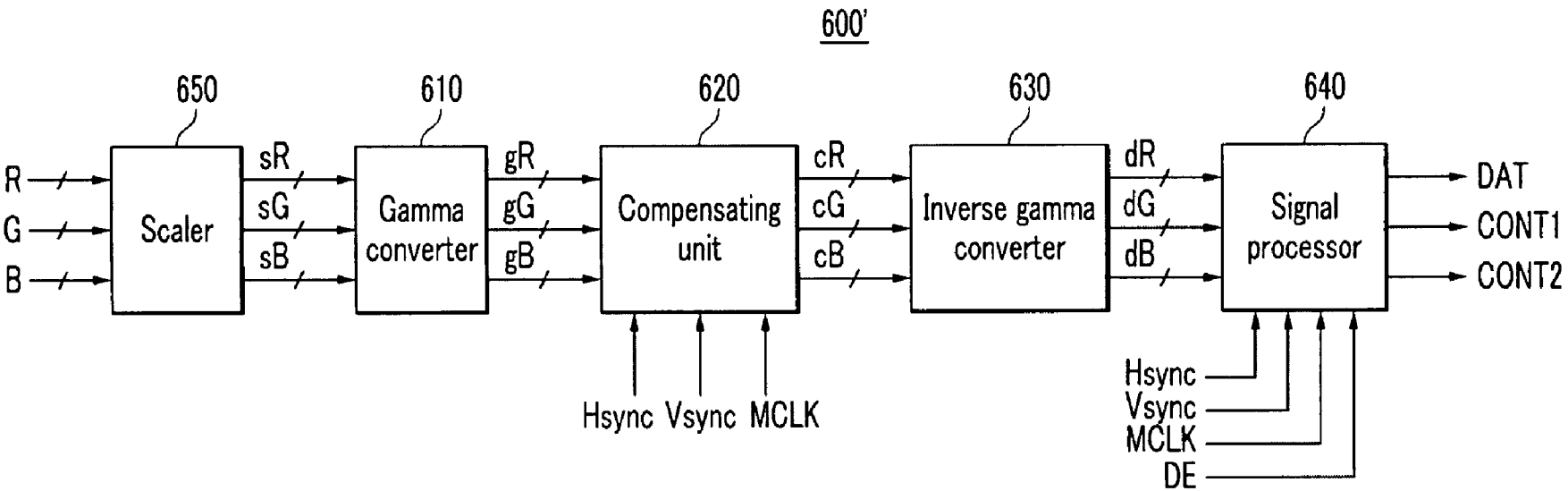
FIG. 8 is a block diagram showing a signal controller of an organic light emitting display according to another exemplary embodiment of the present invention.

FIG. 8 is a block diagram showing a signal controller of an organic light emitting display according to another exemplary embodiment of the present invention.

Referring to FIG. 8, a signal controller 600' may further include a scaler 650, and the scaler 650 converts the input image signals R, G, and B according to the scale coefficient SC. For example, the scaler 650 may convert the input image signals R, G, and B by multiplying the input image signals R, G, and B by the scale coefficient SC. In this case, the scale coefficient SC may have a value between 0 and 1. Alternatively, the input image signals R, G, and B may be converted according to a function that is determined by the scale coefficient SC.

The scaler 650 calculates the amount of current that flows through the display panel 300 during one frame on the basis of the input image signals R, G, and B. The amount of current, which is a total sum of the current that flows through the organic light emitting elements LD of all the subpixels PX of the display panel 300, may be calculated as the total sum of the input image signals R, G, and B during one frame. In addition, when the current amount is not more than the threshold current amount, the scaler 650 sets the scale coefficient SC as 1, and when the current amount is more than the threshold current amount, the scaler 650 may set the scale coefficient SC to have a small value, when the current amount increases. The threshold current amount is determined by the characteristic of the display panel 300, and may be the current amount of when the current amount is large and the voltage drop generated along the driving voltage lines begins to affect the luminance.

The gamma converter 610 performs a gamma conversion on the input image signals sR, sG, and sB that are output by the scaler 650, and transmits the gamma-converted image signals gR, gG, and gB to the compensating unit 620.

As a result, since the magnitudes of the input image signals sR, sG, and sB that are output by the scaler 650 when the current amount of the input image signals R, G, and B is large become smaller than those of the input image signals R, G, and B, the entire current amount of the display panel 300 can be reduced. Accordingly, the voltage drop generated along the driving voltage lines may be reduced, and thus brightness uniformity of the screen may be improved.

Next, an exemplary embodiment where one pixel includes red, green, blue, and white subpixels will be described in detail with reference to FIG. 9, FIG. 10, FIG. 11, and FIG. 12.

Figure 9:
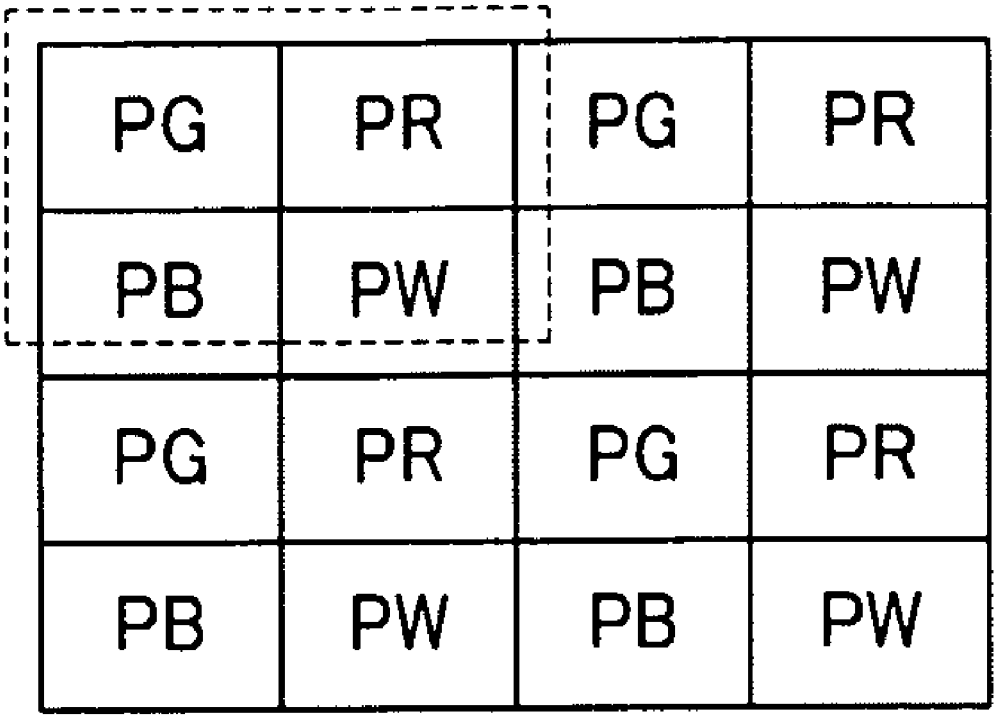
FIG. 9 is a plan view showing a pixel of an organic light emitting display according to another exemplary embodiment of the present invention.
Figure 10:
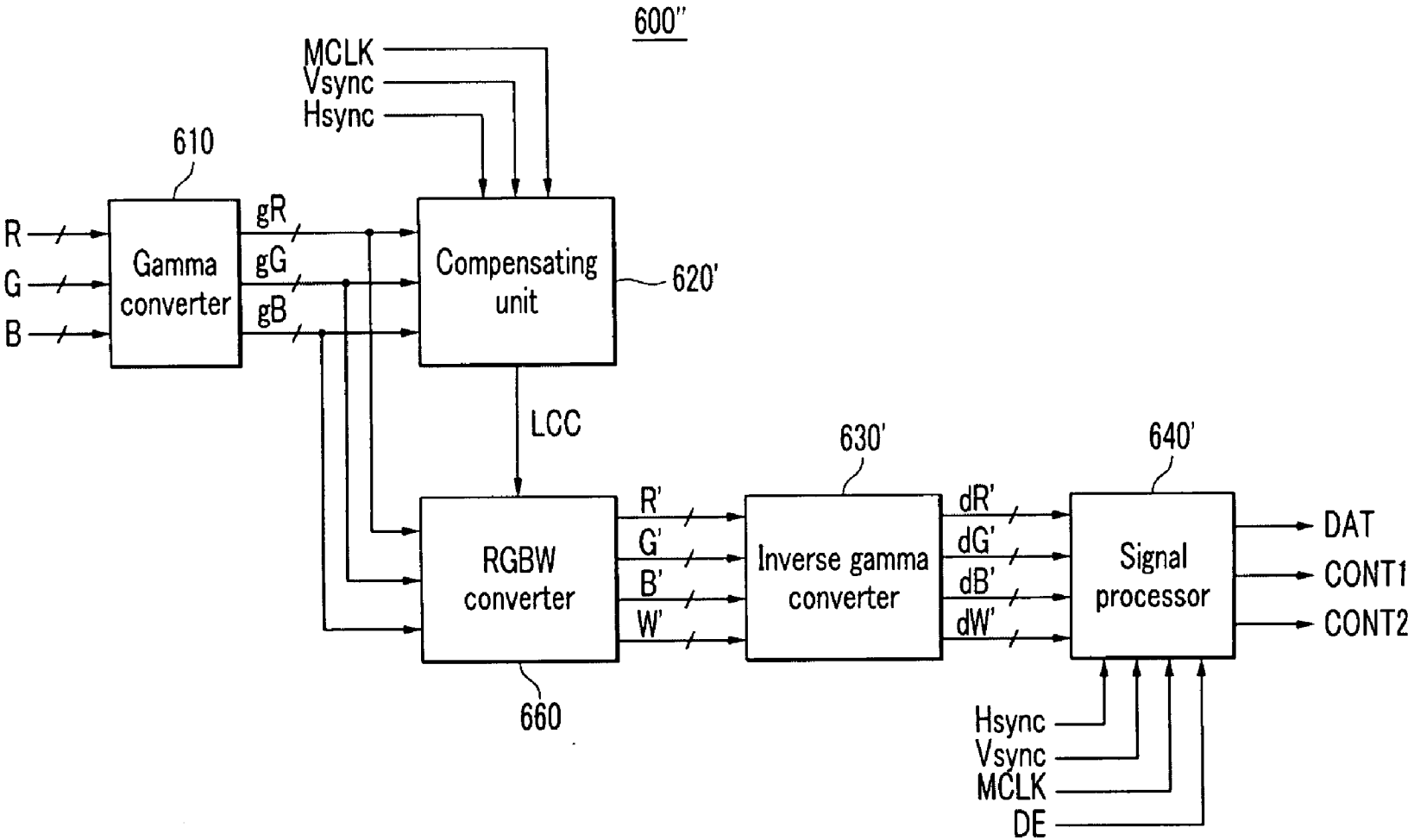
FIG. 10 is a block diagram showing a signal controller of an organic light emitting display according to another exemplary embodiment of the present invention.
Figure 11:
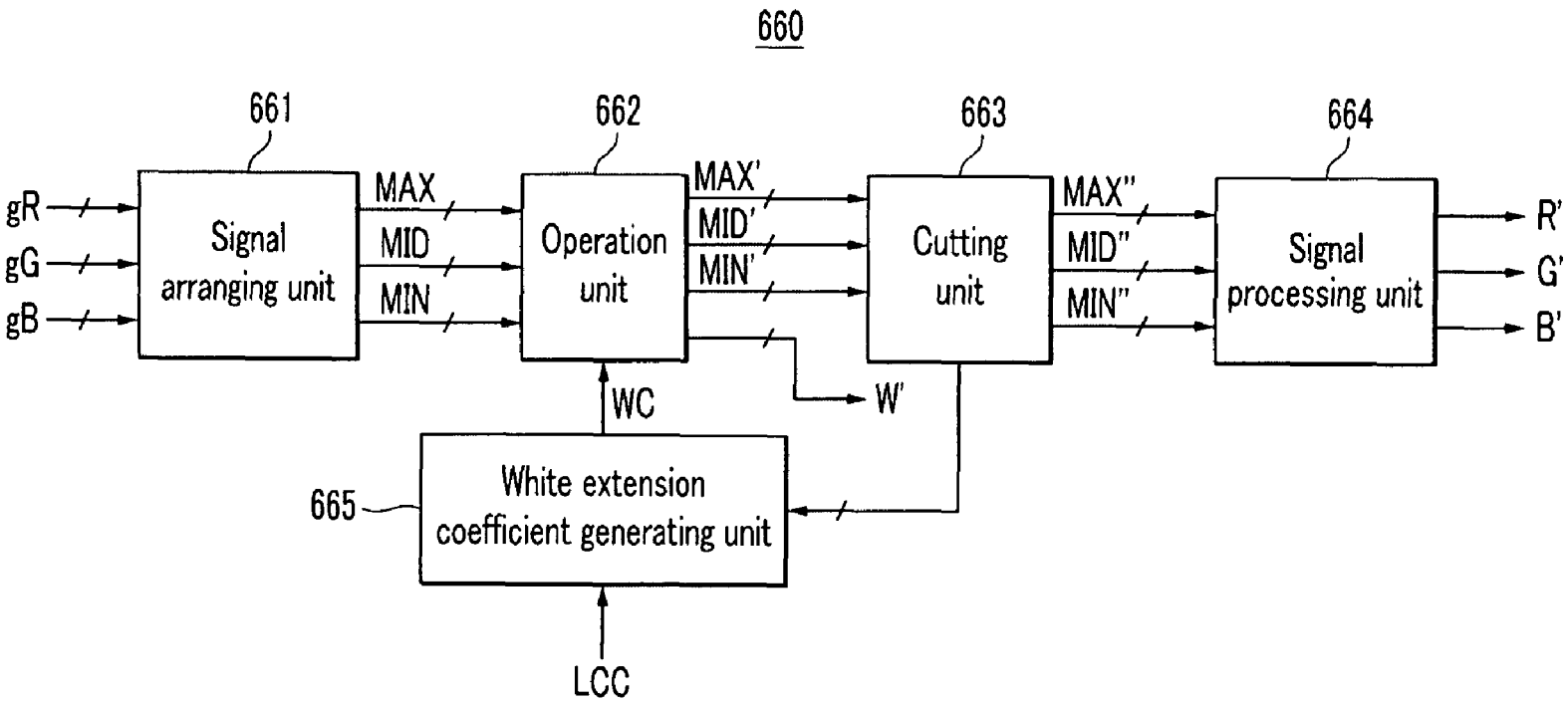
FIG. 11 is a block diagram showing an example of an RGBW converter shown in FIG. 10.
Figure 12:
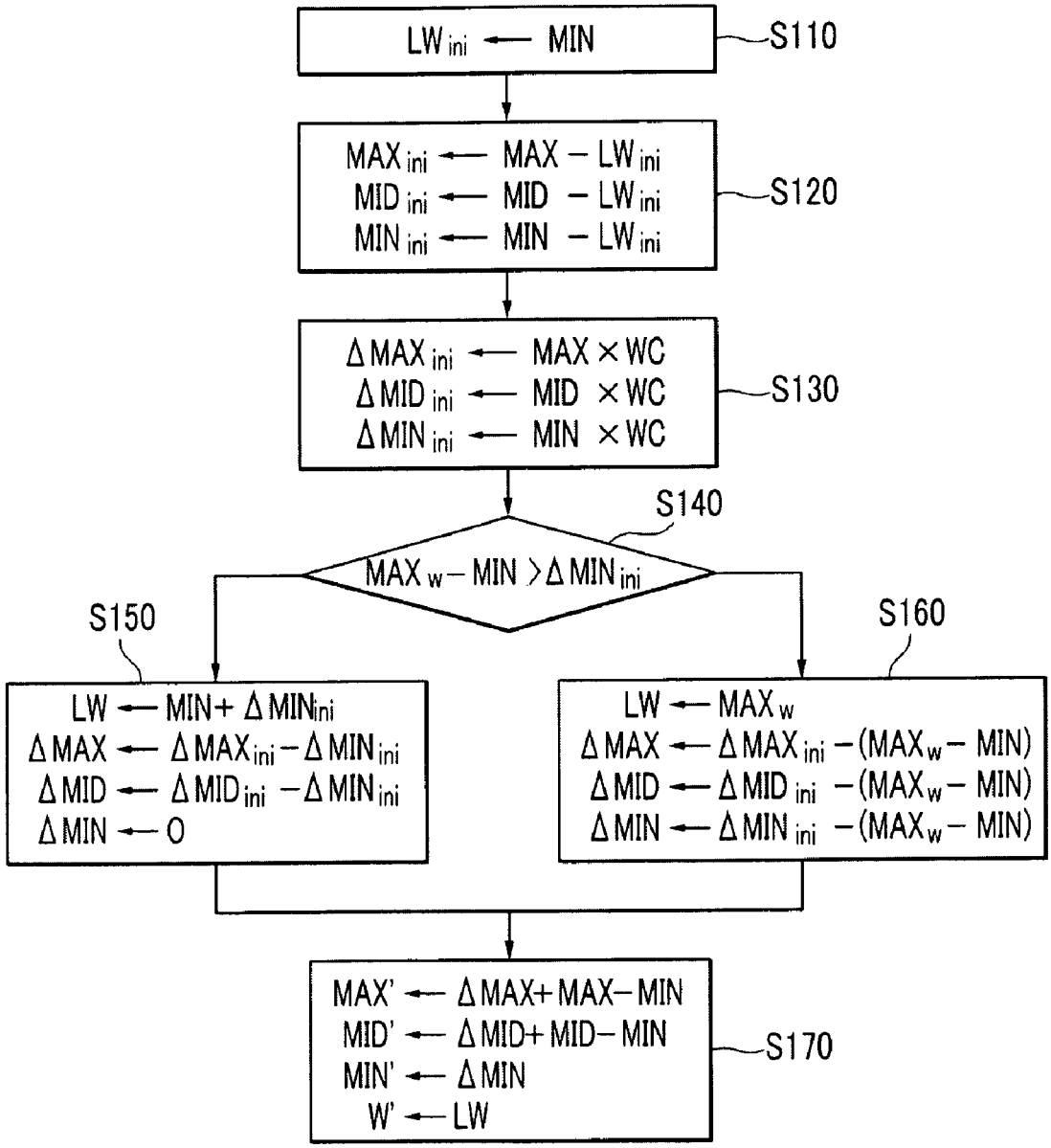
FIG. 12 is a flowchart showing the operation of an operation unit shown in FIG. 11.

FIG. 9 is a plan view showing a pixel of an organic light emitting display according to another exemplary embodiment of the present invention, FIG. 10 is a block diagram showing a signal controller of an organic light emitting display according to another exemplary embodiment of the present invention, and FIG. 11 is a block diagram showing an example of an RGBW converter shown in FIG. 10. FIG. 12 is a flowchart showing the operation of an operation unit shown in FIG. 11.

Referring to FIG. 9, one pixel PX includes a red subpixel PR, a green subpixel PG, a blue subpixel PB, and a white subpixel PW. For example, the four subpixels PR, PG, PB, and PW are arranged in a 2×2 matrix. Alternatively, the four subpixels PR, PG, PB, and PW may be arranged in stripes or quartiles.

Referring to FIG. 10, a signal controller 600" may further include a RGBW converter 660.

The RGBW converter 660 converts image signals gR, gG, and gB that are output by the gamma converter 610 to generate a white compensation image signal W' and red, green, and blue compensation image signals R', G' and B'. For example, the RGBW converter 660 sets the luminance of the white image signal W' as a value corresponding to a common luminance of the image signals gR, gG, and gB, that is, a minimum luminance of the image signals gR, gG, and gB, and compares the luminance of the white compensation image signal W' to the image signals gR, gG, and gB to determine the luminance of the red, green, and blue compensation image signals R', G', and B'. In this case, in order to increase the white luminance, the RGBW converter 660 may reflect a value, which is obtained by multiplying the minimum luminance of the image signals gR, gG, and gB by a predetermined coefficient (hereinafter referred to as "white extension coefficient"), to the minimum luminance of the image signals gR, gG, and gB, and generate the white compensation image signal W'. That is, the RGBW converter 660 may set a sum between a value obtained by multiplying the minimum luminance by the white extension coefficient and the minimum luminance as the white output image signal W'.

In this case, in order to prevent deterioration of the screen brightness uniformity, the RGBW converter 660 may multiply the white extension coefficient by the luminance compensation coefficient LCC output by the compensating unit 620' to compensate for the white extension coefficient. Then, the RGBW converter 660 may use the compensated white extension coefficient to generate the white compensation image signal W' and the red, green, and blue compensation image signals R', G', and B'.

In this case, different from the compensating unit 620 shown in FIG. 4, the compensating unit 620' may not multiply the image signals gR, gG, and gB by the luminance compensation coefficient LCC, but may output only the luminance compensation coefficient LCC.

An inverse gamma converter 630' performs an inverse gamma conversion on the red, green, blue, and white compensation image signals R', G', B', and W' of the RGBW converter 660. The inverse gamma converter 630' may be formed for each of the colors, or may be equally formed for at least two colors.

A signal processor 640' processes the input control signals, for example the horizontal synchronization signal Hsync, the vertical synchronization signal Vsync, the main clock signal MCLK, and the data enable signal DE, and the inverse-gamma-converted image signals dR', dG', dB', and dW' to generate a digital image signal DAT, a scan control signal CONT1, and a data control signal CONT2.

An example of the RGBW converter 660 will be described in detail with reference to FIG. 11 and FIG. 12.

Referring to FIG. 11, the RGBW converter 660 includes a signal arranging unit 661, an operation unit 662, a cutting unit 663, a signal rearranging unit 664, and a white extension coefficient generating unit 665.

The signal arranging unit 661 arranges the red, green, and blue image signals gR, gG, and gB in the order of luminance, and outputs a maximum luminance signal MAX, a middle luminance signal MID, and a minimum luminance signal MIN. That is, the maximum luminance signal MAX is a signal that has the highest luminance among the three image signals gR, gG, and gB, the minimum luminance signal MIN is a signal that has the lowest luminance among the three image signals gR, gG, and gB, and the middle luminance signal MID is the remaining signal.

Referring to FIG. 11 and FIG. 12, the operation unit 662 sets the minimum luminance signal MIN as an initial white luminance signal $LW_{ini}$ (S110), and subtracts a value of each of the luminance signals MAX, MID, and MIN by a value of the initial white luminance signal $LW_{ini}$ (S120). Hereinafter, signals $MAX-LW_{ini}$, $MID-LW_{ini}$, and $MIN-LW_{ini}$ that are obtained by subtracting the values of the individual luminance signals MAX, MID, and MIN by the value of the initial white luminance signal $LW_{ini}$ are referred to as an initial maximum luminance signal $MAX_{ini}$, an initial middle luminance signal $MID_{ini}$, and an initial minimum luminance signal $MIN_{ini}$. In this case, the initial minimum luminance signal has a value of 0.

The operation unit 662 multiplies the three luminance signals MAX, MID, and MIN by the white extension coefficient WC to set an initial maximum luminance compensation value $\Delta MAX_{ini}$, an initial middle luminance compensation value $\Delta MID_{ini}$, and an initial minimum luminance compensation value $\Delta MIN_{ini}$ (S130). The initial luminance compensation values $\Delta MAX_{ini}$, $\Delta MID_{ini}$, and $\Delta MIN_{ini}$ satisfy Equation 1.

$$\Delta MAX_{ini}=MAX\times WC, \Delta MID_{ini}=MID\times WC, \Delta MIN_{ini}=MIN\times WC \quad \text{(Equation 1)}$$

When images are displayed using the red, green, and blue image signals gR, gG, and gB, luminance of the minimum luminance signal MIN that is a common luminance of the three image signals gR, gG, and gB becomes basic white luminance. In order to increase the white luminance, the operation unit 662 adds a predetermined value to the minimum luminance signal MIN in a range that does not exceed the white maximum luminance $MAX_w$ displayed by the white subpixel PW, and sets it as white luminance. To do so, first, the operation unit 662 compares a white luminance margin value, which corresponds to a difference $MAX_w-MIN$ between the white maximum luminance $MAX_w$ displayed by the white subpixel PW and the minimum luminance signal MIN, and the initial minimum luminance compensation value $\Delta MIN_{ini}$ (S140). When the white luminance margin value $MAX_w-MIN$ is larger than the initial minimum luminance compensation value $\Delta MIN_{ini}$, the operation unit 662 adds the initial minimum luminance compensation value $\Delta MIN_{ini}$ to the minimum luminance signal MIN and outputs it as the white luminance signal LW (S150). In order to reduce red, green, and blue luminance by an increase $\Delta MIN_{ini}$ in the white luminance, the operation unit 662 outputs values, which are obtained by subtracting the initial maximum, middle, and minimum luminance compensation values $\Delta MAX_{ini}$, $\Delta MID_{ini}$, and $\Delta MIN_{ini}$ by the initial minimum luminance compensation value $\Delta MIN_{ini}$, as maximum, middle, and minimum luminance compensation values ΔMAX, ΔMID, an ΔMIN (S150). In this case, the minimum luminance compensation value ΔMIN is zero.

Meanwhile, when the white luminance margin value $MAX_w-MIN$ is not more than the initial minimum luminance compensation value $\Delta MIN_{ini}$, the operation unit 662 outputs the maximum white luminance $MAX_w$ as a white luminance signal LW (S160). In this case, since the white luminance increases by the white luminance margin value $MAX_w-MIN$, the operation unit 662 outputs values, which are obtained by subtracting the initial maximum, middle, and minimum luminance compensation values $\Delta MAX_{ini}$, $\Delta MID_{ini}$, and $\Delta MIN_{ini}$ by the white luminance margin value $MAX_w-MIN$, as the maximum, middle, and minimum luminance compensation values ΔMAX, ΔMID, and ΔMIN (S160).

Next, the operation unit 662 adds the maximum, middle, and minimum luminance compensation values ΔMAX, ΔMID, and ΔMIN to the initial maximum, middle, and minimum luminance signals $MAX_{ini}$, $MID_{ini}$, and $MIN_{ini}$ and outputs them as the maximum compensation luminance signal MAX', the middle compensation luminance signal MID', and the minimum compensation luminance signal MIN' (S170). Further, the operation unit 662 sets the white luminance signal LW as the white compensation image signal W'. The maximum, middle, and minimum compensation luminance signals MAX', MID', and MIN' satisfy Equation 2.

$$MAX'=\Delta MAX+MAX_{ini}=\Delta MAX+(MAX-MIN)$$

$$MID'=\Delta MID+MID_{ini}=\Delta MID+(MID-MIN)$$

$$MIN'=\Delta MIN+MIN_{ini}=\Delta MIN \quad \text{(Equation 2)}$$

Next, the cutting unit 663 compares the maximum, middle, and minimum compensation luminance signals MAX', MID', and MIN' with the threshold luminance. As the compared result, the cutting unit 663 converts the luminance of the signal exceeding the threshold luminance among the maximum, middle, and minimum compensation luminance signals MAX', MID', and MIN' into the threshold luminance, and outputs the signal. When the luminance of the signal does not exceed the threshold luminance, the signal is output without a conversion. For example, the threshold luminance may be set as the minimum value among the maximum luminance of the red, green, and blue subpixels PR, PG, and PB, and have different threshold luminance according to a color. Further, when luminance of any one of the maximum, middle, and minimum compensation luminance signals MAX', MID', and MIN' is higher than the threshold luminance, the cutting unit 663 transmits the corresponding information to the white extension coefficient generating unit 665.

The signal rearranging unit 664 rearranges the maximum, middle, and minimum compensation luminance signals MAX", MID", and MIN" output by the cutting unit 663 as the red, green, and blue compensation image signals R', G', and B' according to the arrangement information in the signal arranging unit 661

The white extension coefficient generating unit 665 counts the frequency of the luminance of any one of the maximum, middle, and minimum compensation luminance signals MAX', MID', and MIN' becoming equal to or higher than the threshold luminance in a predetermined period unit, for example, a frame unit. The white extension coefficient generating unit 665 determines the initial white extension coefficient $WC_{ini}$ (not shown) of the current frame according to the frequency of the previous frame. In this case, when the frequency of the previous frame is large, the white extension coefficient generating unit 665 may set the initial white extension coefficient $WC_{ini}$ to have a small value, and when the frequency of the previous frame is small, the white extension coefficient generating unit 665 may set the initial white extension coefficient $WC_{ini}$ to have a large value. The white extension coefficient generating unit 665 may store the initial white extension coefficient $WC_{ini}$ according to the frequency in the form of a lookup table.

The white extension coefficient generating unit 665 incorporates (?) the luminance compensation coefficient LCC output by the compensating unit 620' to the initial white extension coefficient $WC_{ini}$ to output the white extension coefficient WC. For example, the white extension coefficient generating unit 665 may multiply the initial white extension coefficient $WC_{ini}$ by the luminance compensation coefficient LCC to output the white extension coefficient WC.

When the luminance of the maximum, middle, and minimum compensation luminance signals MAX', MID', and MIN' of the operation unit 662 frequently exceeds the threshold luminance, the luminance is high over the entire screen. Accordingly, it may be possible to decrease the luminance of the compensation luminance signals LW, MAX', MID', and MIN' of the operation unit 662 by decreasing the white extension coefficient WC. In contrast, when the luminance of the maximum, middle, and minimum compensation luminance signals MAX', MID', and MIN' of the operation unit 662 rarely exceeds the threshold luminance, the luminance is low over the entire screen. Accordingly, it may be possible to increase the luminance of the compensation luminance signals LW, MAX', MID', and MIN' of the operation unit 662 by increasing the white extension coefficient WC. Further, when the luminance of the pixel determined on the basis of the image signals gR, gG, and gB is high, the luminance compensation coefficient LCC is small, and thus the white extension coefficient WC can be further decreased. Accordingly, when the luminance of the pixels of the display panel 300 is high, the voltage drop that is generated along the driving voltage lines may be reduced by decreasing the luminance of the luminance compensation signals LW, MAX', MID', and MIN' of the operation unit 662. Therefore, it may be possible to reduce luminance deviation according to pixel positions.

Meanwhile, in FIG. 10 and FIG. 11, the gamma converter 610 performs a gamma conversion on the input image signals R, G, and B and the signal arranging unit 661 arranges the image signals gR, gG, and gB in the order of high grays. Alternatively, the signal arranging unit 661 may arrange the input image signals R, G, and B in the order of high grays and the gamma converter 610 performs a gamma conversion on the input image signals. In this way, the operation order of the signal rearranging unit 664 and the inverse gamma converter 630' may be changed.

The scaler 650 that has been described with reference to FIG. 8 may be applied to the exemplary embodiment shown in FIG. 10 and FIG. 11.

As such, according to an exemplary embodiment of the present invention, luminance change according to pixel position due to the voltage drop generated in the driving voltage lines and the screen brightness uniformity can be prevented.

According to an exemplary embodiment of the present invention, luminance change according to pixel position when pixel luminance is high and deterioration of screen brightness uniformity can be prevented.

According to an exemplary embodiment of the present invention, even when the white image signal is generated from the input image signals, deterioration of screen brightness uniformity can be prevented.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a plurality of pixels;

a signal controller that compensates luminance of an input image signal that corresponds to each pixel according to a luminance compensation coefficient that depends on a position of each pixel and a magnitude of the input image signal that corresponds to each pixel to generate a compensation image signal; and a data driver that generates data signals that correspond to the plurality of pixels according to the compensation image signal and that supplies the data signals to the corresponding pixels, respectively.

2. The display device of claim 1, wherein the signal controller compensates luminance of the input image signal according to the luminance compensation coefficient only when the magnitude of the input image signal is equal to or larger than a threshold value.

3. The display device of claim 1, wherein the luminance compensation coefficient is determined by a position compensation coefficient that depends on the position of each pixel and a gray compensation coefficient that depends on the magnitude of the input image signal that corresponds to each pixel.

4. The display device of claim 3, further comprising:

a plurality of driving voltage lines that supply a driving voltage to the plurality of pixels;

at least one voltage supply line connected to the plurality of driving voltage lines; and at least one voltage supply pad connected to the at least one voltage supply line and that transmits the driving voltage to the at least one voltage supply line, wherein the signal controller generates the position compensation coefficient such that a luminance of a first pixel according to the compensation image signal is lower than a luminance of a second pixel, according to the compensation image signal, the input image signal of the second pixel having the same magnitude as the input image signal of the first pixel, and the first pixel is closer to the voltage supply pad than the second pixel along the driving voltage lines and the at least one voltage supply line.

5. The display device of claim 4, wherein:

the signal controller stores the position compensation coefficients for positions of only some of the pixels among the plurality of pixels; and the signal controller determines the position compensation coefficients for positions of the other pixels by interpolating the stored position compensation coefficients.

6. The display device of claim 4, wherein:

the signal controller determines the gray compensation coefficient to decrease luminance of the compensation image signal when the magnitude of the input image signal is equal to or larger than the threshold value; and the signal controller generates the gray compensation coefficient to increase a decrement of the luminance of the compensation image signal as the magnitude of the input image signal increases.

7. The display device of claim 4, wherein a value of the luminance compensation coefficient decreases as the position of the corresponding pixel becomes close to the position of the voltage supply pad along the driving voltage line and the voltage supply line, and decreases as the magnitude of the corresponding input image signal increases.

8. The display device of claim 7, wherein:

the luminance compensation coefficient corresponds to a difference between 1 and a value obtained by multiplying the position compensation coefficient by the gray compensation coefficient;

a value of the position compensation coefficient decreases as the position of the corresponding pixel becomes close to the position of the voltage supply pad along the driving voltage line and the voltage supply line; and a value of the gray compensation coefficient decreases as the magnitude of the corresponding input image signal increases.

9. The display device of claim 8, wherein the gray compensation coefficient is zero when the magnitude of the input image signal is smaller than the threshold value.

10. The display device of claim 7, wherein:

the input image signal that corresponds to each pixel comprises a first image signal that indicates a first color, a second image signal that indicates a second color, and a third image signal that indicates a third color; and the signal controller multiplies the first image signal, the second image signal, and the third image signal by the luminance compensation coefficient to generate the compensation image signals.

11. The display device of claim 7, wherein:

the input image signal that corresponds to each pixel comprises a first image signal that indicates a first color, a second image signal that indicates a second color, and a third image signal that indicates a third color;

the signal controller generates the compensation image signal from the first image signal, the second image signal, and the third image signal; and the compensation image signal comprises a fourth image signal that indicates the first color, a fifth image signal that indicates the second color, a sixth image signal that indicates the third color, and a seventh image signal that indicates a white color.

12. The display device of claim 11, wherein:

the signal controller generates the seventh image signal on the basis of an addition value between an eighth image signal determined on the basis of a minimum luminance among luminance of the first image signal, the second image signal, and the third image signal, and a value obtained by multiplying luminance of the eighth image signal by a predetermined coefficient; and the predetermined coefficient depends on the luminance compensation coefficient.

13. The display device of claim 12, wherein:

the predetermined coefficient is determined by a multiplication between a white extension coefficient and the luminance compensation coefficient;

the white extension coefficient is determined by a frequency of the addition value that equals or exceeds a threshold luminance in a predetermined period unit; and the white extension coefficient decreases when the frequency increases.

14. The display device of claim 1, wherein:

the signal controller multiplies an externally received image signal by a scale coefficient to generate the input image signal; and a value of the scale coefficient decreases as the magnitude of the image signal received during one frame increases.

15. A method of driving a display device that comprises a plurality of pixels, the method comprising:

determining positions of the plurality of pixels;

calculating a magnitude of an input image signal that corresponds to each pixel;

generating a luminance compensation coefficient that depends on the position of each pixel and the magnitude of the input image signal;

compensating luminance of the input image signal that corresponds to each pixel in accordance with the luminance compensation coefficient to generate a compensation image signal; and allowing each pixel to emit light in accordance with the compensation image signal.

16. The method of claim 15, wherein the compensation of the luminance comprises compensating for the luminance of the input image signal in accordance with the luminance compensation coefficient only when the magnitude of the input image signal is equal to or larger than a threshold value.

17. The method of claim 15, wherein the display device further comprises:

a plurality of driving voltage lines that supply a driving voltage to the plurality of pixels;

at least one voltage supply line connected to the plurality of driving voltage lines; and at least one voltage supply pad connected to the at least one voltage supply line and that transmits the driving voltage to the at least one voltage supply line, wherein the generation of the luminance compensation coefficient comprises generating the luminance compensation coefficient such that a luminance of a first pixel according to the compensation image signal is lower than a luminance of a second pixel, according to the compensation image signal, the input image signal of the second pixel having the same magnitude as the input image signal of the first pixel, and wherein the first pixel is closer to the voltage supply pad than the second pixel along the driving voltage lines and the at least one voltage supply line.

18. The method of claim 15, wherein the generation of the luminance compensation coefficient comprises:

determining the luminance compensation coefficient to decrease luminance of the compensation image signal when the magnitude of the input image signal is equal to or larger than the threshold value; and generating the luminance compensation coefficient to increase a decrement of the luminance of the compensation image signal as the magnitude of the input image signal increases.

19. The method of claim 15, wherein:

the input image signal that corresponds to each pixel comprises a first image signal that indicates a first color, a second image signal that indicates a second color, and a third image signal that indicates a third color; and the compensation of the luminance comprises multiplying the first image signal, the second image signal, and the third image signal by the luminance compensation coefficient to generate the compensation image signals.

20. The method of claim 15, wherein the input image signal that corresponds to each pixel comprises a first image signal that indicates a first color, a second image signal that indicates a second color, and a third image signal that indicates a third color, and the compensation of the luminance comprises:

determining a minimum luminance among luminance of the first image signal, the second image signal, and the third image signal;

generating a fourth image signal indicating a white color on the basis of the minimum luminance; and generating a white compensation image signal indicating the white color on the basis of an addition value between a value obtained by multiplying luminance of the fourth image signal by a coefficient depending on the luminance compensation coefficient and the fourth image signal, and wherein the compensation image signal comprises the white compensation image signal.

* * * * *